US008091476B2

(12) United States Patent
Nakazawa et al.

(10) Patent No.: US 8,091,476 B2
(45) Date of Patent: Jan. 10, 2012

(54) WEB CONVEYANCE METHOD AND APPARATUS OF TANDEM PRINTING SYSTEM

(75) Inventors: Souichi Nakazawa, Hitachinaka (JP); Yuji Ohmura, Hitachinaka (JP); Toru Kikuchi, Hitachinaka (JP); Sho Sawahata, Hitachinaka (JP)

(73) Assignee: Ricoh Company, Ltd., Tokyo (JP)

( * ) Notice: Subject to any disclaimer, the term of this patent is extended or adjusted under 35 U.S.C. 154(b) by 985 days.

(21) Appl. No.: 12/014,122

(22) Filed: Jan. 15, 2008

(65) Prior Publication Data

US 2008/0181710 A1 Jul. 31, 2008

(30) Foreign Application Priority Data

Jan. 30, 2007 (JP) ..... 2007-019329

(51) Int. Cl.
*B41F 13/24* (2006.01)

(52) U.S. Cl. ..... 101/232; 101/220

(58) Field of Classification Search ..... 101/232
See application file for complete search history.

(56) References Cited

U.S. PATENT DOCUMENTS

| | | | | |
|---|---|---|---|---|
| 6,476,923 | B1 * | 11/2002 | Cornell | 358/1.12 |
| 6,567,621 | B2 * | 5/2003 | Miyoshi et al. | 399/19 |
| 6,799,507 | B2 * | 10/2004 | Ohba et al. | 101/228 |
| 6,969,206 | B2 * | 11/2005 | Iwanaga et al. | 400/618 |
| 6,999,711 | B2 * | 2/2006 | Suzuki et al. | 399/336 |
| 7,099,029 | B2 * | 8/2006 | Hopper | 358/1.15 |
| 7,220,071 | B2 * | 5/2007 | Baker et al. | 400/611 |
| 7,242,494 | B2 * | 7/2007 | Hanazato | 358/1.15 |
| 7,284,486 | B2 * | 10/2007 | Winter et al. | 101/485 |
| 7,539,453 | B2 * | 5/2009 | Otome et al. | 399/384 |
| 2002/0131804 | A1 * | 9/2002 | Nakazawa et al. | 400/580 |
| 2003/0077095 | A1 * | 4/2003 | Conrow | 399/364 |

FOREIGN PATENT DOCUMENTS

JP 2004-292133 10/2004

* cited by examiner

*Primary Examiner* — Anthony Nguyen
(74) *Attorney, Agent, or Firm* — Antonelli, Terry, Stout & Kraus, LLP.

(57) ABSTRACT

By executing low-speed conveyance of web by a web feeding mechanism before the printing operation begins, slack W22*a*, W10*a*, and W15*a* in the web located downstream of the guide rollers, and the slacked web is accumulated in the air loop portion, thereby completing the standby for printing. At that time, the amount of web conveyance (accumulation) is saved. Then, high-speed printing operation begins, and when the amount of printing has reached the amount of web conveyance saved, high-speed conveyance by the web feeding mechanism begins.

12 Claims, 3 Drawing Sheets

WEB CONVEYANCE METHOD AND APPARATUS OF TANDEM PRINTING SYSTEM

CLAIM OF PRIORITY

The present application claims priority from Japanese application serial No. 2007-019329, filed on Jan. 30, 2007, the content of which is hereby incorporated by reference into this application.

FIELD OF THE INVENTION

The present invention relates to a web conveyance method and apparatus of a tandem printing system in which a plurality of printers are tandemly arranged.

BACKGROUND OF THE INVENTION

FIG. 2 shows an example of a tandem printing system in which two printers P1 and P2 are tandemly arranged in order to create images on both sides of a web which is illustrated as a long, continuous belt-like paper. That is, a web W is fed to the printer P1 in the first stage and images are formed on its first surface (main surface) by an image-forming apparatus 19. And, after the web W has been turned over by a turn bar T and then fed into the printer P2 in the subsequent stage, images are formed by an image-forming apparatus 20 on the second surface (back-side surface) of the web W. Thus, this is a double-side printing system.

FIG. 3 shows an example of a spot-color tandem printing system in which the printing with a first color is executed by printer P1 in the first stage and then the printing with a second color is executed by printer P2 in the subsequent stage.

The present invention relates to a web conveyance method and apparatus of those tandem printing systems.

FIG. 4 shows the outline of conveying the web in the tandem printing system.

A web W which has on its first surface an image created by printer P1 is discharged from the printer P1 by a carrier roller 15. The web W is guided to printer P2 via a guide roller 8, a guide roller 9, and a guide roller 10 which constitute a turn bar T disposed subsequently after the printer P1. The web W is then fed into a web feeding mechanism 23 via a guide roller 7 and a guide roller 22; and after an air loop 24 has been formed, the web W is conveyed to an image-forming apparatus 20 by a carrier roller 21. After an image has been formed on the second surface of the web W by the image-forming apparatus 20, the web W is discharged from the printer P2 by a carrier roller 25.

Herein, the carrier roller 15 of the printer P1, web feeding mechanism 23 of the printer P2, carrier roller 21, and the carrier roller 25 are all capable of conveying the web W. On the other hand, the guide rollers 8 to 10 which constitute a turn bar T and the guide rollers 7 and 22 located at the entrance of the printer P2 are driven rollers having no conveyance capability or unrotatable, immovable rollers.

In the above-mentioned tandem printing system, the guide roller 22 and guide rollers 7 to 10, located upstream of the web feeding mechanism 23, create a load on the web W during the printing operation, which prevents slack in the web along the path of the web as shown as W22*b* and W10*b*.

When the printing operation is stopped, the inertia of the web W itself or the inertia of the rollers disposed on the web conveyance path causes the web to be conveyed too much, which creates slack W22*a* and slack W10*a* between the two printers P1 and P2. For example, if the printing operation begins in the state where slack W22*a* is present as shown in the drawing, the portion of the web located downstream of the web feeding mechanism 23 accelerates, while the portion of the web upstream of the guide roller 22 remains stationary. If acceleration of the portion of the web W located downstream of the web feeding mechanism 23 has stopped before slack W22*a* disappears; at the moment when slack W22*a* disappears, the portion of the web located upstream of the guide roller 22 is momentarily accelerated at the highest speed. For this reason, a great deal of impulse is to be imposed on the portion of the web between the web feeding mechanism 23 and the guide roller 22. At this time, if the web feeding mechanism 23 has a weak conveyance force, an error which eliminates the air loop 24 will stop printing, and if the web W is thin, the web W may break. The same phenomena will occur in and around slack W10*a*.

To avoid such phenomena, for example, as disclosed in Japanese patent laid-open No. 2004-292133, a method in which a web is conveyed early by a web feeding mechanism 23 has been proposed.

SUMMARY OF THE INVENTION

In a tandem printing system, the amount of slack occurring in the web differs depending on the configuration of the tandem printing system and the type of the web. That is, the amount of slack in the web changes according to conditions including friction force occurring between a turn bar and the web, the inertia moment of guide rollers that constitute the turn bar, and the weight of the web. For this reason, it is difficult to detect early the timing at which a web is conveyed by the above-mentioned web feeding mechanism 23. Therefore, depending on the configuration of the tandem printing system or the type of the web, the slack in the web occurs when the printing operation has stopped, and at the moment when the slack disappears due to the start of the printing operation, the web may break or some malfunction may occur, thereby causing unstable conveyance of the web.

An objective of the present invention is to provide a web conveyance method or an apparatus of a tandem printing system which inhibits the web from breaking or some kind of malfunction from occurring at the moment when the slack in the web is taken in due to the start of the printing operation, thereby achieving reliably constant conveyance of the web.

The present invention, in an aspect, is a tandem printing system which comprises first and second printers tandemly arranged to form images on a web, a web feeding mechanism for feeding the web into the second printer, and an air loop mechanism disposed subsequently after the web feeding mechanism to create slack in the web and convey the web; wherein a tensile force of the web that has been discharged from the first printer is detected, and the resulted tensile force is reported to the control apparatus of the second printer; and when the control apparatus of the second printer receives a standby-for-printing instruction and also receives information indicating that the resulted tensile force is less than a prescribed value, the web feeding mechanism starts conveying the web at a low speed; and when information indicating that the resulted tensile force has exceeded the prescribed value is received, the low-speed web conveyance is halted.

In a preferred embodiment of the present invention, at the receipt of the information indicating that the web's tensile force exceeds a prescribed value, an instruction to start the printing operation is provided, and according to the start-printing instruction, high-speed web conveyance begins.

Furthermore, in a preferred embodiment of the present invention, after the high-speed web conveyance has started according to the start of printing, and when the amount of the remaining web in the air loop mechanism becomes less than a prescribed value, high-speed web conveyance by the web feeding mechanism begins.

According to preferred embodiments of the present invention, malfunctions including a broken web are prevented thereby achieving stable web conveyance.

Other objectives and characteristics of the present invention will be clearly described in the embodiments described hereafter.

DESCRIPTION OF THE PREFERRED EMBODIMENTS

Figure 2:
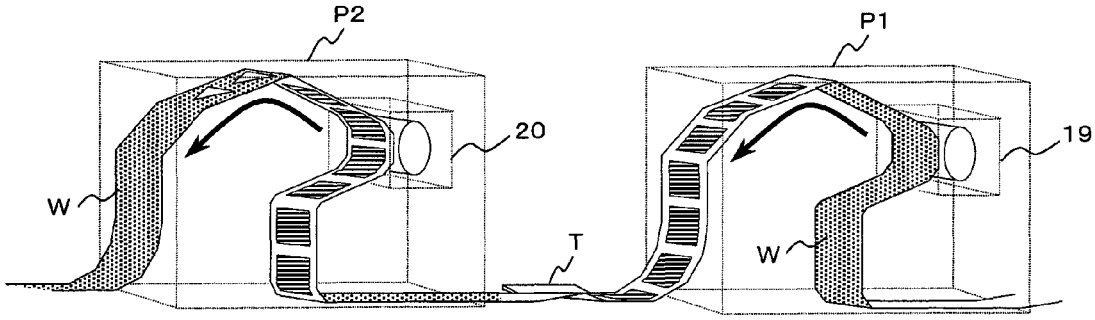
FIG. 2 is an image drawing of the printing operation executed by a double-side tandem printing system.
Figure 3:
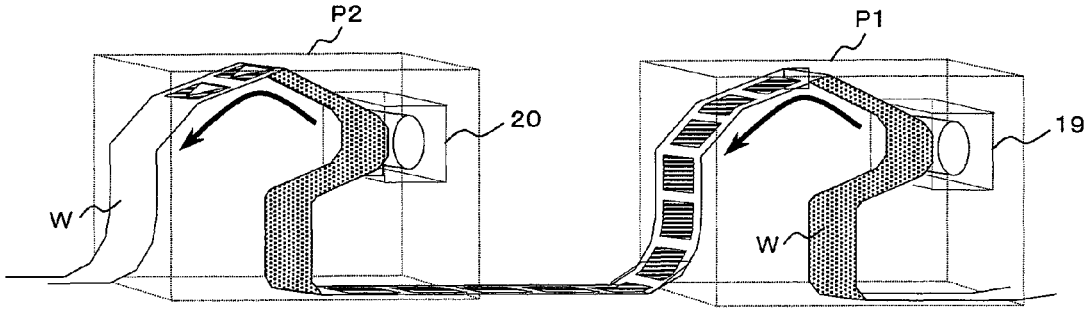
FIG. 3 is an image drawing of the printing operation executed by a spot-color tandem printing system.

Next, embodiments of the present invention will be described with reference to the drawings. The present invention can be applied to both tandem printing systems shown in FIG. 2 and FIG. 3; however, in the descriptions below, the tandem printing system including a turn bar T, shown in FIG. 2, is given as an example.

Figure 1:
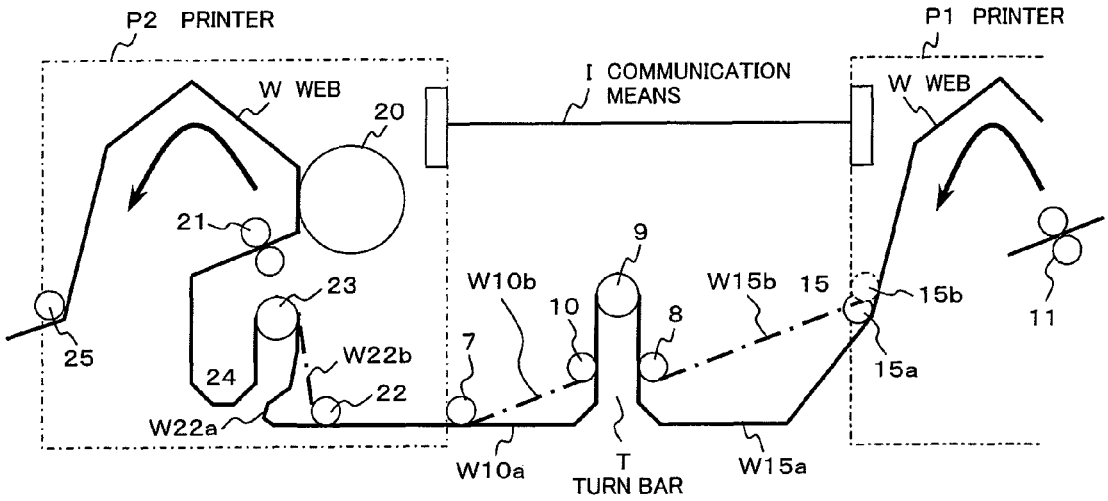
FIG. 1 is a schematic drawing of a tandem printing system which is an embodiment of the present invention.
Figure 4:
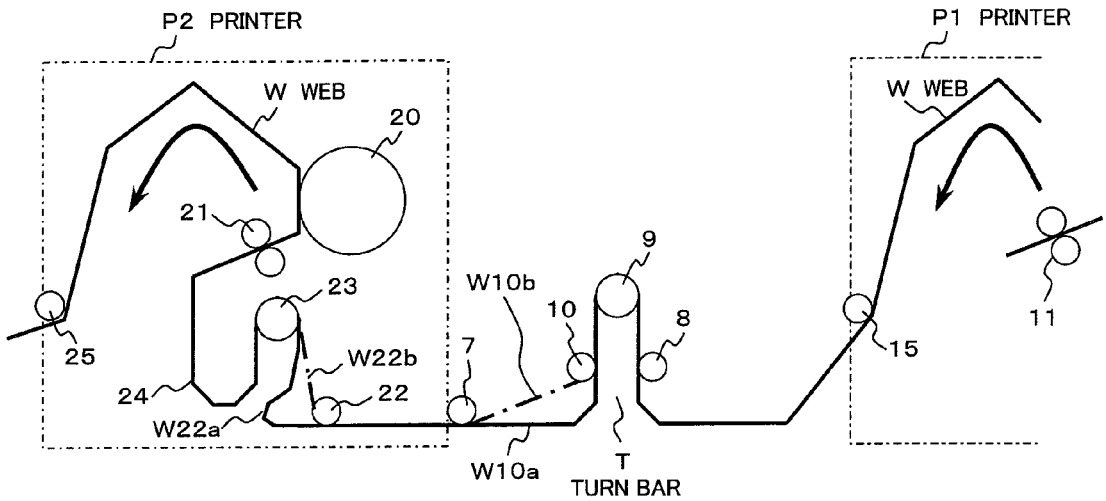
FIG. 4 shows an example of the condition of the web in the tandem printing system.

FIG. 1 is a schematic drawing of a tandem printing system which is an embodiment of the present invention. Herein, a tandem printing system shown in FIG. 4 incorporates a mechanism for detecting a web's tensile force that is imposed on a carrier roller 15 and a communication means I for reporting information about the web's tensile force to printer P2. The carrier roller 15 is designed such that it moves up and down according to the web's tensile force imposed on the carrier roller 15 of the printer P1. By detecting the up and down movement of the roller, it is possible to detect a web's tensile force imposed on the carrier roller 15. Furthermore, the information about the web's tensile force is reported to the control apparatus of the printer P2 via a communication means I.

Figure 5:
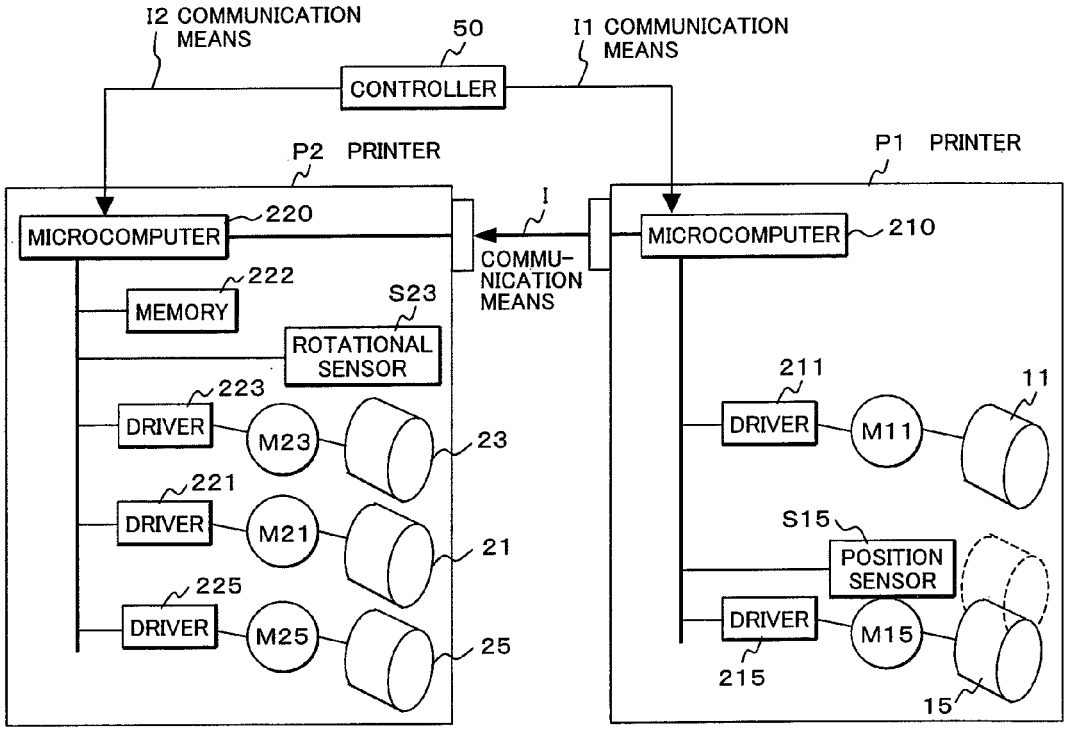
FIG. 5 is a diagram of the control block of a tandem printing system which is an embodiment of the present invention.

FIG. 5 is a diagram of the control block in this embodiment.

First of all, printer P1 comprises a microcomputer 210 for controlling the operation of the printer, a motor M11 for providing a rotational drive force to a carrier roller 11, and a motor driver 211 for driving the motor M11. The printer P1 further comprises a motor M15 for providing a rotational drive force to a carrier roller 15 and a motor driver 215 for driving the motor M15. Furthermore, the printer P1 also includes a position sensor S15 for detecting the up and down positions of the carrier roller 15.

The microcomputer 210 receives a start-printing instruction from an upper-level controller 50, which controls the tandem printing system, via a communication means I1, emits a drive signal to motor drivers 211 and 215, thereby executing high-speed web conveyance to conduct the printing operation. Furthermore, the microcomputer 210 monitors the signal from a position sensor S15 and reports the information via a communication means I to a microcomputer 220 for controlling printer P2.

Next, printer P2 also comprises a microcomputer 220 for controlling the operation of the printer, a motor M21 for providing a rotational drive force to a carrier roller 21, and a motor driver 221 for driving the motor M21. The printer P2 further comprises a motor M23 for providing a rotational drive force to a web feeding mechanism 23, a motor driver 223 for driving a motor M23, a motor M25 for providing a rotational drive force to the carrier roller 25 and a motor driver 225 for driving the motor M25. Furthermore, the printer P2 also includes a rotational sensor S23 for detecting the rotation of the web feeding mechanism 23 and a memory 222.

In the same manner as printer 1, the microcomputer 220 receives a start-printing instruction from an upper-level controller 50 via a communication means I2, emits a drive signal to motor drivers 221 and 225, thereby executing high-speed web conveyance to conduct the printing operation. Furthermore, the microcomputer 220 monitors the rotational sensor S23 while emitting a drive signal to the motor driver 223 and conveying the web, and by measuring the number of revolutions of the web feeding mechanism 23, the microcomputer 220 calculates the amount of conveyance of the web. Moreover, the microcomputer 220 is designed such that it receives information about the web's tensile force reported via the communication means I.

Figure 6:
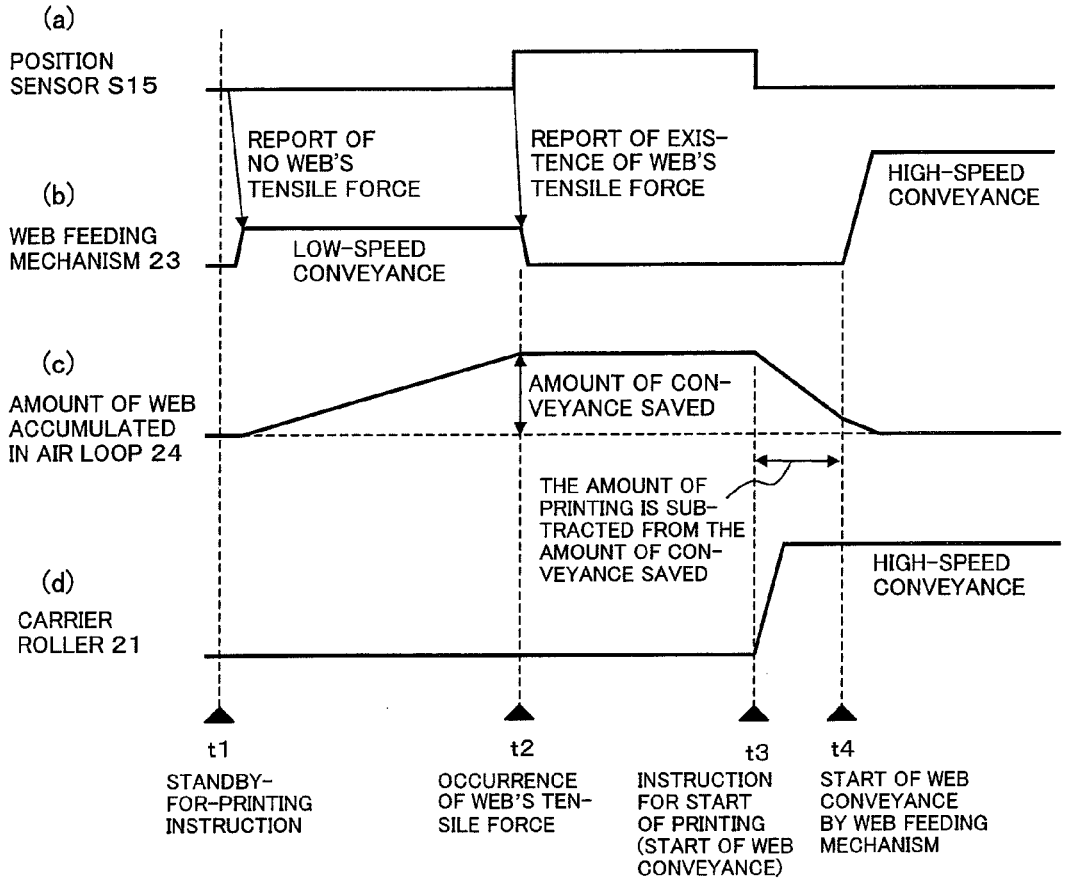
FIG. 6 is a time chart of the web conveyance procedure in a tandem printing system which is an embodiment of the present invention.

FIG. 6 is a time chart of the web conveyance procedure in a tandem printing system, shown in FIGS. 1 and 5, which is an embodiment of the present invention. Hereafter, the operation of the system will be described with reference to the drawings.

(1) At timing t1, a standby-for-printing instruction is supposed to be sent from the upper-level controller 50 to each microcomputer 210 and 220 of the printers P1 and P2 thereby activating both printers to be ready for the printing operation. The printer P1 side microcomputer 210 reports the condition of the position sensor S15 to the printer P2 side microcomputer 220. At this time, when the carrier roller 15 is located at position 15*a* shown in FIG. 1, there is no web's tensile force, which means that the web W is in the state of W15*a*, W10*a*, and W22*a*. On the other hand, when the carrier roller 15 is located at position 15*b* in FIG. 1, there is a tensile force on the web, which means that the web W is in the state of W15*b*, W10*b*, and W22*b*.

When information received by the printer P2 side microcomputer 220 indicates no web's tensile force (less than a prescribed value), the microcomputer 220 starts low-speed web conveyance by the web feeding mechanism 23 as shown in FIG. 6(*b*). At the same time, as shown in FIG. 6(*c*), the amount of web conveyance by the web feeding mechanism 23, that is, the amount of web accumulated by the air loop 24 starts to be measured. At this time, the speed of the low-speed web conveyance should be set sufficiently low to prevent damage to the web, including a broken or folded web, from occurring due to the web's tensile force and also should be set as high as possible to prevent the reduction of printout efficiency (throughput).

On the other hand, when information received by the printer P2 side microcomputer 220 indicates the existence of web's tensile force (more than a prescribed value), it is determined that there is no slack of the web, and low-speed web conveyance by the web feeding mechanism 23 is not executed.

(2) At timing t2, the position sensor S15 is supposed to detect position 15*b* in FIG. 1 (existence of web's tensile force). Then, the printer P1 side microcomputer 210 reports the information to the printer P2 side microcomputer 220. When the printer P2 side microcomputer 220 receives the information indicating the existence of web's tensile force, it stops the low-speed web conveyance by the web feeding mechanism 23, and saves the amount of web conveyance by the web feeding mechanism 23 that has been measured in the memory 222.

Figure 7:
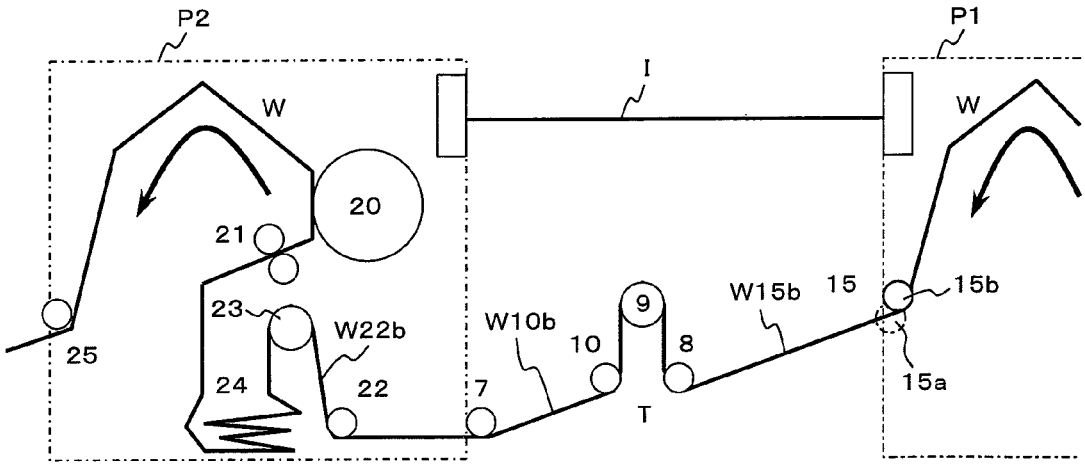
FIG. 7 shows an example of the condition of the web when standby for printing has been completed in a tandem printing system which is an embodiment of the present invention.

FIG. 7 shows an example of the condition of the web when standby for printing has been completed in a tandem printing system which is an embodiment of the present invention. The drawing shows the condition in which the web is accumulated in the air loop 24 at the timing t2. Thus, slack in the web W which was present at positions W15*b*, W10*b*, and W22*b* has been eliminated, and excessive portions of web W are collected in the air loop 24. This is the condition when the printer P2's standby for printing has been completed.

On the other hand, as stated above, when low-speed web conveyance by the web feeding mechanism 23 is not executed, the amount of web conveyance is indicated as "0" and saved in the memory 222. Furthermore, even if low-speed web conveyance by the web feeding mechanism 23 has reached the constant amount of conveyance, if the printer P2 could not receive information indicating the existence of web's tensile force, an error seems to be occurring. Accordingly, low-speed web conveyance by the web feeding mechanism 23 is halted, and an error is reported, such as no web, broken web, malfunction of the web feeding mechanism 23, or abnormality in the communication means I.

(3) The upper-level controller 50 receives information indicating the existence of web's tensile force and can emit a start-printing instruction when the condition shown in FIG. 7 has been reached. In FIG. 6, the time interval from timing t2 to timing t3 seems to be long, however, it is possible to start printing immediately.

Now, at timing t3, a start-printing instruction is supposed to be sent from the controller 50 to each microcomputer 210 and 220 of the printers P1 and P2. In response, the printers P1 and P2 drive a carrier roller 21, carrier roller 25 and a carrier roller 15 simultaneously thereby starting high-speed web conveyance to execute the printing operation. At this time, when the amount of web conveyance saved in the memory 222 is "0," the web feeding mechanism 23 simultaneously starts high-speed web conveyance.

On the other hand, when the amount of web conveyance saved in the memory 222 is not "0," the number of printed pages (the amount of printing) is compared with the amount of web conveyance saved in the memory 222, and at the time when the difference is close to "0," high-speed web conveyance by the web feeding mechanism 23 begins. By doing so, slack in the web accumulated in the air loop 24 portion, as shown in FIG. 7, as the result of the conveyance by the carrier rollers 21 and 25 is eliminated, and at the moment when the air loop 24 shown in FIG. 1 is formed, high-speed web conveyance by the web feeding mechanism 23 can begin. Furthermore, moderate slack is also formed in the web located downstream of the carrier roller 15.

By starting the printing operation according to the procedure mentioned above, it is possible to accelerate the web while a tensile force is being provided on the web located upstream of the web feeding mechanism 23, therefore, high-speed web conveyance is possible without providing more impulse than necessary. Furthermore, by executing the above-mentioned low-speed web conveyance by the web feeding mechanism 23 right before executing the printing operation, stable web conveyance becomes possible because a tensile force can be imposed on the web for a short time thereby preventing the web from curling.

What is claimed is:

1. A web conveyance method of tandem printing system wherein first and second printers to form images on a web are tandemly arranged, and there are provided a web feeding mechanism for feeding a web into said second printer and an air loop mechanism disposed subsequently after the web feeding mechanism to create slack in the web and convey the web; said web conveyance method of tandem printing system, comprising:

at the time of the start of standby for printing, a step of detecting a tensile force of the web at least one position from a downstream of a web discharge part of the first printer to an upstream of the web feeding mechanism of the second printer, a step of reporting the resulted tensile force to a control apparatus of said second printer, a step of starting low-speed web conveyance by the web feeding mechanism when the control apparatus of said second printer receives information indicating that said resulted tensile force is less than a prescribed value, and starting a measurement of an amount of web accumulated in the air loop mechanism, the web being accumulated by the low-speed web conveyance, and a step of halting the low-speed web conveyance when information indicating that the resulted tensile force has exceeded the prescribed value is received, and saving in a memory the amount of web accumulated in the air loop mechanism, the web being accumulated by the low-speed web conveyance, at a time of start of a printing, a step of starting high-speed conveyance of the web by web conveyance mechanisms other than the web feeding mechanism, and starting the measurement of an amount of conveyances of the web, the web being conveyed by the high-speed conveyance, and a step of starting a high-speed conveyance by the web feeding mechanism when the difference between the amount of the web accumulation in the air loop mechanism and the amount of the high-speed conveyance of the web becomes below a predetermined value.

2. The web conveyance method of tandem printing system according to claim 1, wherein said first printer creates an image on the first surface of said web, and said second printer creates an image on the second surface of said web.

3. The web conveyance method of tandem printing system according to claim 2, wherein the first surface and the second surface of said web are reversed by a turn bar disposed between said first and second printers.

4. The web conveyance method of tandem printing system according to claim 1, wherein said first printer creates an image with a first color on a surface of said web, and said second printer creates an image with a second color on the surface of said web.

5. The web conveyance method of tandem printing system according to claim 1, further comprising a step of measuring the amount of web conveyance by said web feeding mechanism, and a step of halting said low-speed web conveyance when the amount of web conveyance has exceeded a prescribed value.

6. A web conveyance apparatus for tandem printing system wherein first and second printers to form images on a web are tandemly arranged, and there are provided a web feeding mechanism for feeding a web into said second printer and an air loop mechanism disposed subsequently after the web feeding mechanism to create slack in the web and convey the web; said web conveyance apparatus for tandem printing system, comprising a tensile force detecting means for detecting a tensile force of the web at least one position from the downstream of the web discharge part of the first printer to an upstream of the web feeding mechanism of the second printer, a communication means for reporting the output from the tensile force detecting means to a control apparatus of said second printer, a low-speed web conveyance starting means for starting said low-speed web conveyance by said web feeding mechanism when the control apparatus of said second printer receives information indicating that the output from said tensile force detecting means is less than a prescribed value, and starting a measurement of an amount of web accumulated in the air loop mechanism, the web being accumulated by the low-speed web conveyance, a low-speed web conveyance halting means for halting said low-speed web conveyance when the information indicating that the tensile force of the web has exceeded the prescribed value is received, and saving in a memory an amount of web accumulated in the air loop mechanism, the web being accumulated by the low-speed web conveyance, an accumulation web reducing means for reducing the accumulation web in the air pool mechanism by starting a high-speed conveyance of the web by web conveyance mechanisms other than the web feeding mechanism at the time of start of a printing, and starting the measurement of an amount of conveyances of the web, the web being conveyed by the high-speed conveyance, and a high-speed conveyance starting means for starting a high-speed conveyance by the web feeding mechanism when the difference between the amount of the web accumulated in the air loop mechanism saved in the memory and the conveyance amount by the high-speed conveyance under measurement becomes below a predetermined value.

7. A web conveyance method of tandem printing system wherein first and second printers to form images on a web are tandemly arranged, and there are provided a web feeding mechanism for feeding a web into said second printer and a web accumulating mechanism disposed subsequently after the web feeding mechanism to create slack in the web and convey the web, said web conveyance method of tandem printing system, comprising:

at the time of the start of standby for printing, a step of detecting a tensile force of the web at least one position from a downstream of a web discharge part of the first printer to an upstream of the web feeding mechanism of the second printer, a step of reporting the resulted tensile force to a control apparatus of said second printer, a step of starting low-speed web conveyance by the web feeding mechanism when the control apparatus of said second printer receives information indicating that said resulted tensile force is less than a prescribed value, and starting a measurement of an amount of web accumulated in the web accumulating mechanism, the web being accumulated by the low-speed web conveyance, and a step of halting the low-speed web conveyance when information indicating that the resulted tensile force has exceeded the prescribed value is received, and saving in a memory an amount of web accumulated in the web accumulating mechanism, the web being accumulated by the low-speed web conveyance, at a time of start of a printing, a step of starting high-speed conveyance of the web by web conveyance mechanisms other than the web feeding mechanism, and starting the measurement of an amount of conveyances of the web, the web being conveyed by the high-speed conveyance, and a step of starting a high-speed conveyance by the web feeding mechanism when the difference between the amount of the web accumulation in the web accumulating mechanism and the amount of the high-speed conveyance of the web becomes below a predetermined value.

8. The web conveyance method of tandem printing system according to claim 7, wherein said first printer creates an image on the first surface of said web, and said second printer creates an image on the second surface of said web.

9. The web conveyance method of tandem printing system according to claim 8, wherein the first surface and the second surface of said web are reversed by a turn bar disposed between said first and second printers.

10. The web conveyance method of tandem printing system according to claim 7, wherein said first printer creates an image with a first color on a surface of said web, and said second printer creates an image with a second color on the surface of said web.

11. The web conveyance method of tandem printing system according to claim 7, further comprising a step of measuring the amount of web conveyance by said web feeding mechanism, and a step of halting said low-speed web conveyance when the amount of web conveyance has exceeded a prescribed value.

12. A web conveyance apparatus for tandem printing system wherein first and second printers to form images on a web are tandemly arranged, and there are provided a web feeding mechanism for feeding a web into said second printer and the web accumulating mechanism disposed subsequently after the web feeding mechanism to create slack in the web and convey the web, said web conveyance apparatus for tandem printing system, comprising:

a tensile force detecting means for detecting a tensile force of the web at least one position from a downstream of the web discharge part of the first printer to the upstream of the web feeding mechanism of the second printer, a communication means for reporting the output from the tensile force detecting means to a control apparatus of said second printer, a low-speed web conveyance starting means for starting said low-speed web conveyance by said web feeding mechanism when the control apparatus of said second printer receives information indicating that the output from said tensile force detecting means is less than a prescribed value, and starting a measurement of an amount of web accumulated in the web accumulating mechanism, the web being accumulated by the low-speed web conveyance, a low-speed web conveyance halting means for halting said low-speed web conveyance when the information indicating that the tensile force of the web has exceeded the prescribed value is received, and saving in a memory an amount of web accumulated in the web accumulating mechanism, the web being accumulated by the low-speed web conveyance, an accumulation web reducing means for reducing the accumulation web in the web accumulating mechanism by starting a high-speed conveyance of the web by web conveyance mechanisms other than the web feeding mechanism at the time of start of a printing, and starting the measurement of an amount of conveyances of the web, the web being conveyed by the high-speed conveyance, and a high-speed conveyance starting means for starting a high-speed conveyance by the web feeding mechanism when the difference between the amount of the web accumulated in the web accumulating mechanism saved in the memory and the conveyance amount by the high-speed conveyance under measurement becomes below a predetermined value.

* * * * *